US008114250B2

(12) United States Patent
Jeannot et al.

(10) Patent No.: US 8,114,250 B2
(45) Date of Patent: Feb. 14, 2012

(54) METHOD AND INSTALLATION FOR THE COMBINATION OF PLIES FORMING AN ABSORBENT SHEET

(75) Inventors: Sebastien Jeannot, Holtzwihr (FR); Benoit Hoeft, Bischwihr (FR); Pierre Probst, Ammerschwihr (FR)

(73) Assignee: Georgia-Pacific France, Kunheim (FR)

( * ) Notice: Subject to any disclaimer, the term of this patent is extended or adjusted under 35 U.S.C. 154(b) by 305 days.

(21) Appl. No.: 12/443,209

(22) PCT Filed: Sep. 21, 2007

(86) PCT No.: PCT/FR2007/001539

§ 371 (c)(1), (2), (4) Date: Mar. 27, 2009

(87) PCT Pub. No.: WO2008/037878

PCT Pub. Date: Apr. 3, 2008

(65) Prior Publication Data

US 2010/0006247 A1 Jan. 14, 2010

(30) Foreign Application Priority Data

Sep. 27, 2006 (FR) ..... 06 08490

(51) Int. Cl.
*D21H 11/00* (2006.01)

(52) U.S. Cl. ..... 162/109

(58) Field of Classification Search ..... 162/109, 162/110, 140, 134, 362; 428/154, 171; 156/273.7
See application file for complete search history.

(56) References Cited

U.S. PATENT DOCUMENTS

| | | | |
|---|---|---|---|
| 3,377,224 | A | 4/1968 | Gresham et al. |
| 5,622,734 | A | 4/1997 | Clark et al. |
| 6,824,647 | B2 | 11/2004 | Neveu et al. |

FOREIGN PATENT DOCUMENTS

| | | | |
|---|---|---|---|
| EP | 0672402 | A1 | 9/1995 |
| EP | 1362953 | B1 | 5/2005 |
| EP | 1533112 | A1 | 5/2005 |

OTHER PUBLICATIONS

International Search Report for PCT/FR2007/001539 dated Apr. 16, 2008.

Written Opinion of the International Searching Authority for PCT/FR2007/001539.

*Primary Examiner* — Mark Halpern

(74) *Attorney, Agent, or Firm* — Finnegan, Henderson, Farabow, Garrett & Dunner LLP

(57) ABSTRACT

The present invention relates to a method for the combination of at least two plies of tissue paper without glue and by pressure marking, characterized in that it involves embossing at least one first ply according to an embossing design by passage between a first cylinder and a second cylinder covered externally with a rubber blanket, then combining at least one second ply with the first ply by causing both plies to pass between the first engraved steel cylinder of axis CC' and at least one first series of small externally smooth coaxial cylinders of axis XX'. Both plies are then passed between the first cylinder and a second series of small externally smooth coaxial cylinders of axis YY', the axes CC', XX'; and YY' being horizontal and parallel. The invention also includes the apparatus for carrying out the disclosed method.

47 Claims, 2 Drawing Sheets

METHOD AND INSTALLATION FOR THE COMBINATION OF PLIES FORMING AN ABSORBENT SHEET

This application is a National Stage entry of International Application No. PCT/FR2007/001539, filed Sep. 21, 2007, which claims priority to French Patent Application No. 06 08490, filed on Sep. 27, 2006, the priorities of which are hereby claimed and their disclosures incorporated by reference in their entirety.

The present invention relates to the field of absorbent papers based on cellulose wadding for sanitary or domestic use, such as bathroom tissue, paper towels or any wiping paper, paper napkins, etc.

To produce such products, cellulose wadding, also called tissue paper, is generally used. This is an absorbent paper of low basis weight of between 10 and 45 g/m$^2$, obtained under wet conditions from papermaking fibers. It comprises, if appropriate, chemical additives in small proportions, depending on its intended use. It may be obtained by pressing the still wet sheet on a heated cylinder of large diameter, on which it is dried and from which it is subsequently detached by means of a metal blade laid against the latter transversely to its direction of rotation. The purpose of this operation is to crepe the sheet which then has corrugations transverse to its direction of travel. Creping gives the sheet some elasticity, at the same time as increasing its thickness and affording it touch properties.

Another known method of manufacture comprises a first step of drying the sheet, at least partially, by means of a stream of hot air passing through it. The sheet may subsequently be creped or not.

In general terms the sheet thus manufactured is subsequently transformed in another separate manufacturing phase, called transformation or converting, and is combined with other sheets, which are then designated as plies, so as to form the final product consisting of absorbent paper.

To be precise, when the aim is to give a sheet special properties, such as thickness, softness or bulk, the combination of a plurality of plies with one another may be chosen.

Combination may be of the chemical type, for example adhesive bonding, or else of the mechanical type.

As regards adhesive bonding, the known methods involve depositing a film of glue onto all or part of the surface of one of the plies, then putting the glue-coated surface into contact with the surface of at least one other ply.

This type of combination requires additional specific equipment on the production lines, thus entailing a cost and additional technical difficulties. Moreover, the glue itself is costly, soils the cylinders of the embossing unit and may induce undesirable additional rigidity in the final product, the softness of which will also be reduced by the presence of the glue. These disadvantages have persuaded some manufacturers to adopt combinations of the mechanical type.

In this case, the combination of the plies may be carried out by knurling or by compression in the transformation or converting phase.

Knurling conventionally involves compressing the plies to be combined between a knurling wheel (or engraved wheel provided with elements in relief) and a smooth cylinder.

Each knurled strip thus corresponds to the width of a knurling wheel. The strips may form decorative strips on the sheet.

As an illustration, the patent U.S. Pat. No. 3,377,224 describes a "tissue" paper produced by means of such a method. Since a very limited width of paper is knurled, the delamination of the non-knurled zones is a considerable disadvantage.

Furthermore, combination by knurling is limited when the aim is to produce designs over the entire width. To be precise, even if a large number of knurling wheels are arranged side by side (thus giving rise to a large number of strips), zones without knurling may still remain.

The document EP 1 362 953 illustrates a particular example of an installation and method using knurling. The main difference from the basic method described above is that the combination of the plies takes place in wide parallel strips (direction of travel of the machine) on the sheet, and that a film of additive, such as oil, is applied to at least one of the faces of the sheet, in order to obtain watermark work simultaneously with combination.

Moreover, knurling gives rise, overall, to problems of the visibility of the embossed design, if this exists, since, in a known way, knurling crushes the embossing designs already formed on the sheet.

Furthermore, if a large number of knurling wheels are used, the setting and/or keying of the knurling wheels makes production difficult and complex.

Also known are the document EP 1 533 112 or else EP 0 672 402 which describe methods and installations for the combination of a plurality of plies consisting of tissue paper, according to which combination is carried out by the knurling of the plies which pass between at least one series of knurling wheels engraved according to various designs and a pressure anvil roll or marrying cylinder, under some pressure.

These solutions are useful, but present problems, particularly in terms of the zones (strips) between the knurling wheels, since, once again, since the sheet has not been compressed, the plies forming it are not combined in these zones. The sheets therefore have more or less wide strips which are not combined and are free of designs.

Moreover, these prior solutions cause constraints in terms of the engraving designs of the knurling wheels as soon as the desire is to produce a uniform design over the entire width of the cylinder.

To be precise, after such a combination, with the rolls (or log) obtained being cut to form the final rolls (of multipurpose towels, of bathroom tissue or of another intended use), if there are discontinuities (or absences) of engravings, the cut must necessarily be made in the discontinuities, thus requiring very fine settings and tolerances of the cutting tool.

There is therefore a need for an easy and rapid industrial production of multi-ply sheets consisting of tissue paper which are combined by marking and without adhesive bonding.

The subject of the present invention is a method for the combination of at least two plies based on tissue paper without glue and by pressure marking, characterized in that it involves embossing at least one first ply according to an embossing design by passage between a first cylinder and a cylinder covered externally with a rubber blanket, then combining at least one second ply with the said first ply by causing the said plies to pass between a first engraved steel cylinder of axis CC' and at least one first series of small externally smooth coaxial cylinders of axis XX', then between the said first cylinder and a second series of small externally smooth coaxial cylinders of axes YY', the axes CC', XX' and YY' being horizontal and parallel.

A high-quality combination of a plurality of plies is thus produced in a simple and reliable way and at an expedient production speed.

Combination is carried out according to all or part of the embossing and/or engraving design of the engraved cylinder uniformly over the entire width of the plies to be combined.

According to the invention, the small cylinders of each series are axially apart from one another at a distance substantially equal to their width and are arranged, staggered from one series to the other, in such a way that an overlap width in the cross direction of between 0.1 mm and approximately 10 mm, preferably of 1 mm, is produced.

This characteristic makes it possible to obtain a regularly distributed combination, highly uniform over the entire width of a log, even if the latter is relatively large.

No crease and no delamination are observed on the width produced. The cutting of the rolls is therefore less sensitive, since it requires less accuracy. Production at a higher speed than in the prior art can thus be implemented.

According to a particular embodiment of the invention, at least one of the plies is embossed individually prior to combination.

Without departing from the scope of the invention, at least one of the plies is not embossed before combination.

Moreover, the axes XX' and YY' are angularly apart at an angle $\alpha$, measured along the axis CC', of between 10° and 180°.

Advantageously, the plies pass under a third series of small smooth cylinders cooperating with the said engraved cylinder.

Expediently, all or some of the small cylinders are adjustable individually in terms of their pressure against the engraved cylinder and/or in their axial and/or "pseudo-axial" positioning, as will be explained later.

This modularity and individual adjustment of the knurling wheels (or small cylinders) make it possible to distribute the loads uniformly along the width, whatever its dimension, and, in particular, when the engraved cylinder has a deflection at the centre.

Advantageously, the plies to be combined are laid against the engraved cylinder during and between all the steps of the combination.

Moreover, the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

The invention relates, furthermore, to the installation intended for carrying out the method, as protected by claims 11 to 14 defined below.

Other characteristics, details and advantages of the invention will become apparent more clearly from a reading of the following description given in an illustrative and in no way limiting manner, with reference to the accompanying drawings in which.

Figure 1:
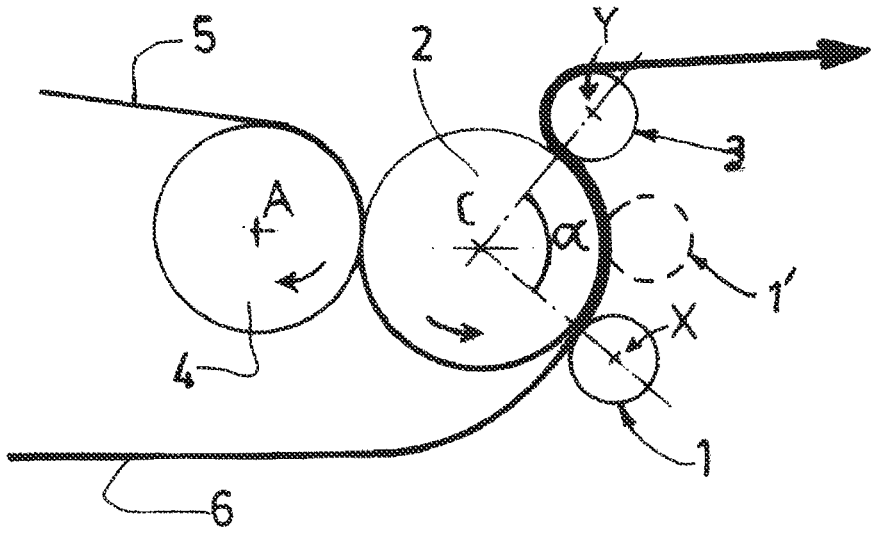
FIG. 1 is a schematic diagram showing principal elements capable of implementing the method according to the invention.

Thus, according to the diagram of FIG. 1, the combination of the plies based on tissue paper is essentially carried out by means of their successive passage between a first series of knurling wheels or small smooth cylinders 1 and an engraved cylinder 2 in the region of the first nip, then between an optional series of knurling wheels or small smooth cylinders 1' and the engraved cylinder 2, and then between a second series of knurling wheels or small smooth cylinders 3 and the said engraved cylinder 2.

The engraved cylinder 2 may consist externally of a steel and has, for example, a diameter of approximately 600 mm and a length of 2700 mm, or even 3400 mm.

Without departing from the scope of the invention, the engraved cylinder 2 may be externally hardened.

Another cylinder 4 covered externally with a rubber blanket is also provided. A rubber of a hardness of between, for example, 40 and 80 ShA (Shore A hardness) is used.

All the cylinders 1, 2, 3, 4 have axes of rotation parallel to one another and horizontal.

Moreover, the small cylinders (or knurling wheels) 1, 3 may be produced from hardened steel.

Advantageously, the cylinders and series of cylinders are arranged, as illustrated in FIG. 1, the axes (CC' and AA' respectively) of the engraved cylinders 2 and of the rubber-blanket cylinder 4 belonging substantially to the same horizontal plane, whilst the axes of rotation XX' and YY' of the small cylinders 1, 3 are angularly apart by an angle $\alpha$, measured along the axis CC' of the engraved cylinder.

The angle $\alpha$ may be between 10° and 180°, preferably between 90° and 150°.

The series of small cylinders 1, 3 are arranged in a sector opposite that to which the rubber-blanket cylinder 4 belongs, so that an equilibrium of the forces applied to the engraved cylinder is implemented substantially and easily.

According to the embodiment illustrated in FIG. 1, a first ply (or group of plies) 5 is embossed between the rubber-blanket cylinder 4 and the engraved cylinder 2.

As will be explained in more detail later, the embossing designs may advantageously be of any type desired, continuous and uniform or not along the width. In other words, the embossing designs may be chosen, without constraint, by the manufacturer.

A second ply or group of plies 6 may, furthermore, be delivered (by any means known per se and not illustrated) into the nip between the engraved cylinder 2 and the first series of knurling wheels 1, where it is combined with the first ply (or group of plies) 5.

Combination is thus carried out in the region of the protuberances of the engraved cylinder, over part of the surface of the plies, in strips parallel to the direction of travel of the sheets.

This combination is completed since the two plies thus positioned and combined subsequently pass into the nip between the second series of small smooth cylinders 3 and the engraved cylinder 2.

Figure 3:
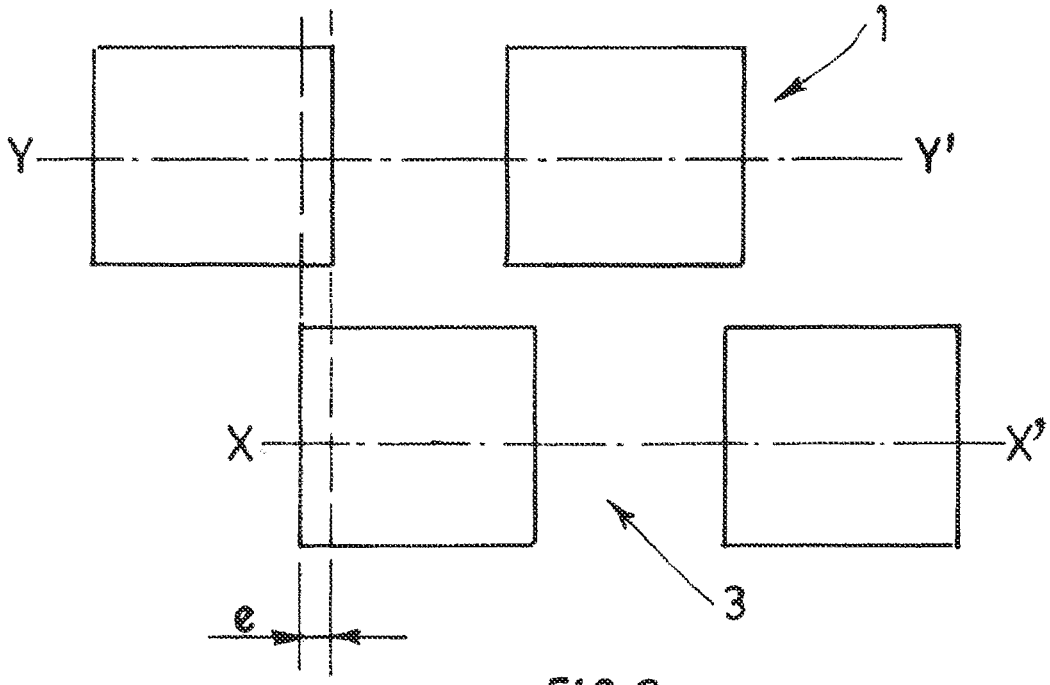
FIG. 3 is a schematic representation of the transverse offset of the knurling wheels or small smooth cylinders of FIG. 1.
Figure 2:
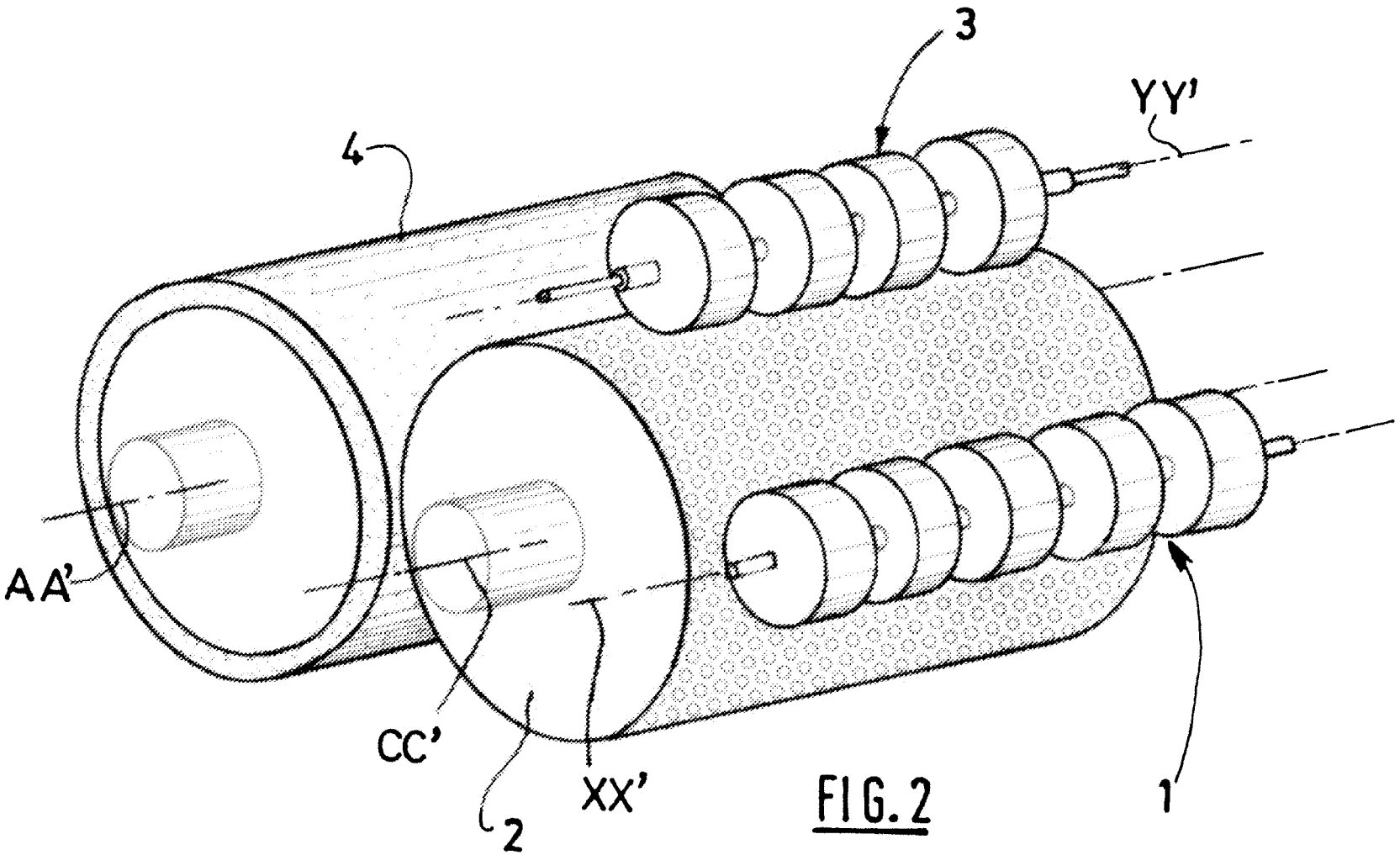
FIG. 2 is a perspective drawing showing the respective positions of the engraved cylinder, of the smooth knurling wheels and of the anvil roll according to an embodiment of the invention.

Since the small smooth cylinders 3 are offset transversely with respect to the small cylinders 1, as can be seen in FIGS. 2 and 3, a combination on the entire surface of the width is thus produced.

Advantageously, an axial zone of overlap (e) of the surfaces covered by the knurling wheels is provided, as illustrated by the diagram of FIG. 3. A more specifically recommended overlap width (e) is at least 0.1 mm and preferably approximately 1 mm. It may reasonably be between 0.1 and 10 mm.

This particular offset ensures the combination over the entire width of the machine breadth, without any non-combined zone and with some tolerance in terms of the positioning of each of the small cylinders.

Advantageously, according to the invention, a better visibility of the embossing design is observed in the region of the combination zones, since the pressure exerted between the engraved cylinder 2 and the small cylinders 1, 3 at the moment of combination gives rise to watermark work in the paper.

The constraints inherent in the known methods (particularly as regards the combination design) are therefore non-existent according to the invention.

The embossing design may be uniform over the entire width, at one or more levels, or else different according to the parallel strips.

Moreover, the second ply (or group of plies) 6 may be embossed or not or creped or not when it meets the first ply 5 at the nip between the engraved cylinder 2 and the first series of small cylinders 1.

Furthermore, the geometric faults of the engraved cylinder 2 and/or the knurling wheels 1, 3 are compensated by the use of individually adjustable knurling wheels: more specifically, the bearing force of each knurling wheel 1, 3 against the engraved cylinder 2 and also its position on one of the axes XX' or YY' can be adjusted.

This modularity in the adjustment of the knurling wheels has a direct impact on the quality of the product obtained.

Each knurling wheel can be displaced along its axis of rotation (XX', YY') in order to set the abovementioned overlap width (e).

The parallelism or "pseudo-axial" setting of each knurling wheel is, furthermore, adjustable. This involves adjusting the axis of rotation of each knurling wheel angularly with respect to the axis of rotation of the engraved cylinder 2.

Without departing from the scope of the invention and without changing the relative position of each of the cylinders or series of cylinders 1, 2, 3, 4, the orientation of this assembly may be different from that illustrated and explained above.

In particular, the axes AA' and CC' of the cylinders 2 and 4 may belong not to a horizontal plane, but to a vertical or substantially vertical plane.

At all events, the aim is to distribute optimally the forces applied to the engraved cylinder 2.

The arrangement of the main elements necessary for the invention advantageously allows the use of the same engraved cylinder 2 both for embossing at least one ply and for combining a plurality of plies by marking.

Moreover, according to a variant of the invention, the knurling wheels may be distributed over more than two axes of rotation, the axes being arranged about the engraved cylinder 2 so as to balance the forces exerted on the cylinder 2.

As an illustration, sheets of bathroom tissue, consisting of two plies of tissue paper of type CWP (Conventional Wet Press) with a total basis weight equal to 42 g/m$^2$, were produced according to the invention. One of the plies is embossed before combination, by means of microembossing comprising more than 30 protuberances/cm$^2$; the other ply is embossed between the cylinders 4 and 2 with a design comprising a regular network of large and small protuberances: the large protuberances being aligned and forming lozenges within which the small protuberances are arranged in high density.

The two plies are combined by means of two series of knurling wheels 1, 3, each knurling wheel of each series having a width of 80 mm; the knurling wheels 1 are offset with respect to the knurling wheels 3 such that there is an overlap (e) of approximately 1 mm.

Moreover, the engraved cylinder 2 was hardened externally and has an external hardness of 57 HRC (Rockwell hardness known to a person skilled in the art). The smooth knurling wheels are hardened externally and have a hardness lower than 2 to 20 HRC with respect to that of the engraved cylinder 2.

As an illustration, the smooth knurling wheels 1, 3 may have an external hardness of 47 HRC.

The speeds of travel of the plies in the region of combination may be of the order of 450 m/mn, or even more, depending on the type of manufacture.

The invention claimed is:

1. A method for combination of at least two plies based on tissue paper without glue and by pressure marking, characterized in that it involves embossing at least one first ply according to an embossing design by passage between a first engraved steel cylinder and a cylinder covered externally with a rubber blanket, then combining at least one second ply with the first ply by causing the plies to pass between the first cylinder on an axis CC and at least one first series of small externally smooth coaxial cylinders on an axis XX', then between the said first cylinder and a second series of small externally smooth coaxial cylinders on an axis YY', the axes CC, XX' and YY' being horizontal and parallel.

2. The method according to claim 1, characterized in that combination is carried out over all or part of the said embossing design.

3. The method according to claim 2, characterized in that the small cylinders of each series are axially apart from one another at a distance substantially equal to their width and are arranged, staggered from one series to the other, so as to obtain an overlap width (e) in the cross direction of between approximately 0.1 mm and approximately 10 mm.

4. The method according to claim 2, characterized in that the second ply is not embossed before combination.

5. The method according to claim 2, characterized in that all or some of the small cylinders are adjustable individually in terms of their pressure against the engraved cylinder and/or in their axial and/or pseudo-axial positioning.

6. The method according to claim 2, characterized in that the plies to be combined are laid against the engraved cylinder during and between all the steps of the combination.

7. The method according to claim 2, characterized in that the axes XX' and YY' are spaced angularly at an angle $\alpha$, measured along the axis CC of the first engraved steel cylinder, the angle $\alpha$ being between 10° and 180°.

8. The method according to claim 2, characterized in that the plies pass under a third series of small smooth coaxial cylinders cooperating with the said engraved cylinder.

9. The method according to claim 2, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

10. The method according to claim 2, characterized in that the small cylinders of each series are axially apart from one another at a distance substantially equal to their width and are arranged, staggered from one series to the other, so as to obtain an overlap width (e) in the cross direction of approximately 1 mm.

11. The method according to claim 1, characterized in that the small cylinders of each series are axially apart from one another at a distance substantially equal to their width and are arranged, staggered from one series to the other, so as to obtain an overlap width (e) in the cross direction of between approximately 0.1 mm and approximately 10 mm.

12. The method according to claim 11, characterized in that the second ply is embossed individually prior to combination.

13. The method according to claim 11, characterized in that the second ply is not embossed before combination.

14. The method according to claim 11, characterized in that all or some of the small cylinders are adjustable individually in terms of their pressure against the engraved cylinder and/or in their axial and/or pseudo-axial positioning.

15. The method according to claim 11, characterized in that the plies to be combined are laid against the engraved cylinder during and between all the steps of the combination.

16. The method according to claim 11, characterized in that the axes XX' and YY' are spaced angularly at an angle α, measured along the axis CC of the first engraved steel cylinder, the angle α being between 10° and 180°.

17. The method according to claim 11, characterized in that the plies pass under a third series of small smooth coaxial cylinders cooperating with the said engraved cylinder.

18. The method according to claim 11, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

19. The method according to claim 1, characterized in that the second ply is embossed individually prior to combination.

20. The method according to claim 19, characterized in that the second ply is not embossed before combination.

21. The method according to claim 19, characterized in that all or some of the small cylinders are adjustable individually in terms of their pressure against the engraved cylinder and/or in their axial and/or pseudo-axial positioning.

22. The method according to claim 19, characterized in that the plies to be combined are laid against the engraved cylinder during and between all the steps of the combination.

23. The method according to claim 19, characterized in that the axes XX' and YY' are spaced angularly at an angle α, measured along the axis CC of the first engraved steel cylinder the angle α being between 10° and 180°.

24. The method according to claim 19, characterized in that the plies pass under a third series of small smooth coaxial cylinders cooperating with the said engraved cylinder.

25. The method according to claim 19, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

26. The method according to claim 1, characterized in that the second ply is not embossed before combination.

27. The method according to claim 26, characterized in that all or some of the small cylinders are adjustable individually in terms of their pressure against the engraved cylinder and/or in their axial and/or pseudo-axial positioning.

28. The method according to claim 26, characterized in that the plies to be combined are laid against the engraved cylinder during and between all the steps of the combination.

29. The method according to claim 26, characterized in that the axes XX' and YY' are spaced angularly at an angle α, measured along the axis CC of the first engraved steel cylinder, the angle α being between 10° and 180°.

30. The method according to claim 26, characterized in that the plies pass under a third series of small smooth coaxial cylinders cooperating with the said engraved cylinder.

31. The method according to claim 26, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

32. The method according to claim 1, characterized in that all or some of the small cylinders are adjustable individually in terms of their pressure against the engraved cylinder and/or in their axial and/or pseudo-axial positioning.

33. The method according to claim 32, characterized in that the plies to be combined are laid against the engraved cylinder during and between all the steps of the combination.

34. The method according to claim 32, characterized in that the axes XX' and YY' are spaced angularly at an angle α, measured along the axis CC of the first engraved steel cylinder, the angle α being between 10° and 180°.

35. The method according to claim 32, characterized in that the plies pass under a third series of small smooth coaxial cylinders cooperating with the said engraved cylinder.

36. The method according to claim 32, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

37. The method according to claim 1, characterized in that the plies to be combined are laid against the engraved cylinder during and between all the steps of the combination.

38. The method according to claim 37, characterized in that the axes XX' and YY' are spaced angularly at an angle α, measured along the axis CC of the first engraved steel cylinder, the angle α being between 10° and 180°.

39. The method according to claim 37, characterized in that the plies pass under a third series of small smooth coaxial cylinders cooperating with the said engraved cylinder.

40. The method according to claim 37, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

41. The method according to claim 1, characterized in that the axes XX' and YY' are spaced angularly at an angle α, measured along the axis CC of the first engraved steel cylinder, the angle αbeing between 10° and 180°.

42. The method according to claim 41, characterized in that the plies pass under a third series of small smooth coaxial cylinders cooperating with the said engraved cylinder.

43. The method according to claim 41, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

44. The method according to claim 1, characterized in that the plies pass under a third series of small smooth coaxial cylinders cooperating with the said engraved cylinder.

45. The method according to claim 44, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

46. The method according to claim 1, characterized in that the rubber-blanket cylinder, the first cylinder and the small cylinders are respectively positioned and set in such a way that contact between the first engraved cylinder and each of the small smooth cylinders is made under a specific pressure of between approximately 40 and approximately 250 N/mm$^2$.

47. The method according to claim 1, characterized in that the small cylinders of each series are axially apart from one another at a distance substantially equal to their width and are arranged, staggered from one series to the other, so as to obtain an overlap width (e) in the cross direction of approximately 1 mm.

* * * * *